US006749455B2

(12) United States Patent
Nishide et al.

(10) Patent No.: US 6,749,455 B2
(45) Date of Patent: Jun. 15, 2004

(54) CONNECTOR

(75) Inventors: Satoru Nishide, Yokkaichi (JP); Ryotaro Ishikawa, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/338,944

(22) Filed: Jan. 8, 2003

(65) Prior Publication Data

US 2003/0143885 A1 Jul. 31, 2003

(30) Foreign Application Priority Data

Jan. 30, 2002 (JP) ..... 2002-022053
Feb. 8, 2002 (JP) ..... 2002-032756

(51) Int. Cl.[7] ..... H01R 13/627
(52) U.S. Cl. ..... 439/352; 439/489; 439/188
(58) Field of Search ..... 439/352, 489, 439/353, 350, 351, 355, 357, 356, 188

(56) References Cited

U.S. PATENT DOCUMENTS 6,109,956 A * 8/2000 Kawase et al. ..... 439/489
6,196,867 B1 * 3/2001 Kawase et al. ..... 439/489
6,241,542 B1 * 6/2001 Nishide et al. ..... 439/188
6,280,237 B1 * 8/2001 Saka et al. ..... 439/489
6,319,041 B1 11/2001 Nishide et al.
6,347,952 B1 * 2/2002 Hasegawa et al. ..... 439/352
6,358,081 B1 * 3/2002 Saka et al. ..... 439/352
6,383,009 B2 * 5/2002 Kawase et al. ..... 439/352
6,475,014 B2 * 11/2002 Tsuji et al. ..... 439/352
6,494,732 B2 * 12/2002 Kashiyama et al. ..... 439/352
6,527,578 B2 * 3/2003 Kashiyama et al. ..... 439/352
6,537,098 B2 * 3/2003 Kashiyama et al. ..... 439/352
6,551,146 B2 * 4/2003 Nakamura ..... 439/752
6,561,833 B2 * 5/2003 Saka et al. ..... 439/352
6,595,795 B2 * 7/2003 Nakamura ..... 439/489
2001/0039144 A1 11/2001 Osawa et al.

* cited by examiner

*Primary Examiner*—Ross Gushi
(74) *Attorney, Agent, or Firm*—Gerald E. Hespos; Anthony J. Casella

(57) ABSTRACT

A connector has a housing (20) with a recess (21). A moving plate (50) is located at an initial position in the recess (21) by a resilient restoring force of a spring (40) with a slider (30) held at a returning position in the recess (21). A mating connector moves the moving plate (50) to a connection position in this state and a resilient restoring force is accumulated in the spring (40). If the state of the slider (30) held at the returning position is canceled with the mating connector properly connected and the moving plate (50) at the connection position, the resilient force accumulated in the spring (40) is released as the slider (30) is moved to a releasing position. Thus, the spring (40) is free from permanent set in fatigue.

16 Claims, 17 Drawing Sheets

CONNECTOR

BACKGROUND OF THE INVENTION

1. Field of the Invention

The invention relates to a connector with a moving plate.

2. Description of the Related Art

U.S. Published Patent Appl. No. 2001/0039144 discloses a connector with a housing and an engaging recess that extends into the front end of the housing for receiving a mating connector. Male terminal fittings are accommodated in the housing, and tabs at the front ends of the male terminal fittings project forward in the engaging recess. The connector further includes a moving plate that has positioning holes through which the tabs can pass. The moving plate is movable in the engaging recess between an initial position, where the positioning holes engage the front ends of the tabs, and a connection position, where the positioning holes engage the base ends of the tabs.

The moving plate is at the initial position before the mating connector is connected, and hence the moving plate positions the front ends of the tabs. Thus, the tabs and female terminal fittings in the mating connector are aligned. The moving plate is pushed by the mating connector from the initial position to the connection position as the mating connector is connected.

The connectors may be disconnected and reconnected for maintenance or the like. In such a case, the moving plate needs to be pulled back from the connection position to the initial position to position the tabs before the reconnection of the mating connector. However, the moving plate at the connection position is at the back side of the engaging recess. Thus, a cumbersome operation is necessary to pull the moving plate back to the initial position.

U.S. Pat. No. 6,139,041 discloses a returning spring between the housing and the moving plate. The returning spring accumulates a biasing force as the mating connector is connected. Thus, the biasing force in the returning spring automatically moves the moving plate from the connection position to the initial position as the mating connector is separated.

The returning spring is held constantly in a deformed state while the mating connector is connected with the connector. Such a connected state with the mating connector normally continues for a long time. Thus, the elasticity of the returning spring may be reduced and the returning spring may be set permanently in fatigue with an insufficient biasing force. As a result, the moving plate will not be returned reliably to the initial position.

Moreover, the lock arm of the above-described connector is at the widthwise center and compression coil springs are provided at the opposite lateral sides of the lock arm and above the lock arm. Thus, the connector is large with respect to widthwise and vertical directions.

The present invention was developed in view of the above problems and an object thereof is to improve the operability of the connector.

SUMMARY OF THE INVENTION

The invention is directed to a connector with a housing that has a front end and an engaging recess that extends into the front end. The engaging recess is configured to receive a mating connector from the front. Terminal fittings and a biasing member are disposed in the housing. The biasing member has a first end directly or indirectly engageable with the mating connector. The mating connector pushes the first end of the biasing member and resiliently deforms the biasing member in the process of connecting the mating connector. The connector further has a slider that moves with the first end of the biasing member between a returning position and a releasing position behind the returning position. A holding means holds the slider at the returning position and cancels the held state of the slider. Accordingly, the biasing member is prevented from being permanently set in fatigue so that overall operability of the connector is improved. The terminal fittings preferably are male terminal fittings, and tabs at the front ends of the male terminal fittings project forward in the engaging recess.

The connector may further comprise a moving plate that is movable between an initial position and a connection position. The moving plate has positioning holes that engage the front ends of the tabs to position the tabs in the engaging recess when the moving plate is in the initial position. The positioning holes are substantially at the base ends of the tabs when the moving plate is in the connection position. The moving plate is movable together with first end of the biasing member, and the biasing member biases the moving plate toward the initial position. The mating connector pushes the moving plate from the initial position to the connection position and resiliently deforms the returning spring in the process of connecting the mating connector.

The connector further comprises a slider movable with the second end of the biasing member between a returning position and a releasing position behind the returning position. A holding means is provided for holding the slider at the returning position and canceling the held state of the slider.

The slider exerts a forward pushing force on the second end of the biasing member when the slider is held at the returning position before the mating connector is connected. Thus, the moving plate is moved to the initial position by the resilient restoring force of the biasing member. The slider is kept at the returning position by the holding means in this process. Thus, the mating connector pushes the moving plate and the end of the returning spring back and accumulates a resilient restoring force in the biasing member.

The state of the slider held at the returning position is canceled when the mating connector is connected properly and the moving plate is at the connection position. The resilient force accumulated in the biasing member is released as the slider is moved to the releasing position.

The slider may be moved to the returning position to reconnect the mating connector after being separated. The biasing member then resiliently pushes the moving plate from the connection position to the initial position, and the moving plate positions the tabs.

The force accumulated in the biasing member is released when the mating connector is connected properly and the moving plate is at the connection position. Thus, the biasing member has no permanent set in fatigue.

The holding means preferably is constructed to cancel the held state of the slider as the mating connector is connected properly. Thus, the slider is moved automatically from the returning position to the releasing position, where the biasing force of the biasing member is released. Operability is good because an operation of canceling the holding means need not be performed separately.

The housing preferably comprises a lock arm that is deformable to an unlocking position during connection with the mating connector. The lock arm is resiliently restored to a locking position when the mating connector is connected properly and engages the mating connector to prevent the mating connector from being separated. The slider preferably comprises a movement preventing portion for preventing movement of the slider to the releasing position by engaging the lock arm that has been deformed resiliently to the unlocking position when the slider is at the returning position. The movement preventing portion disengages from the lock arm when the lock arm is returned resiliently to the locking position to permit movement of the slider to the releasing position.

The slider is kept at the returning position if the mating connector is connected insufficiently and the lock arm is at the unlocking position. The slider is moved from the returning position to the releasing position by the resilient restoring force of the biasing member when the lock arm is returned to the locking position to prevent the properly connected mating connector from being separated from the connector. Thus, the locked state of the mating connector by the lock arm can be detected based on whether the slider has been moved to the releasing position.

The slider may further comprise an unlocking piece for engaging the lock arm at the locking position to forcibly deform the lock arm to the unlocking position as the slider is moved from the releasing position toward the returning position.

The slider can be moved toward the returning position while the lock engages the properly connected mating connector. Thus, a biasing force accumulates in the biasing member between the moving plate, which has its movement toward the initial position prevented by the mating connector, and the slider, which is moving toward the returning position. The biasing force accumulated in the biasing member causes the unlocking piece of the slider to deform the lock arm to the unlocking position. Thus, the biasing force of the biasing member also moves the moving plate toward the initial position and pushes the mating connector out of the engaging recess. Movement of the slider from the releasing position toward the returning position cancels the locking by the lock arm. Thus, an operation of canceling locking by the lock arm and an operation of pulling the female connector back by means of the biasing member are performed merely by unlocking the slider. Therefore, operability is good.

The lock arm preferably comprises an accommodation space for accommodating at least part of the biasing member. Thus, the connector can be made smaller with respect to vertical and widthwise directions.

The lock arm preferably is at a substantially widthwise center position and the accommodation space is formed by cutting away a substantially widthwise center portion of the lock arm. The lock arm and the biasing member are placed one over the other along vertical direction. Thus, the connector can be made smaller with respect to vertical direction. It is sufficient to provide only one compression coil spring as the biasing member, and thus the connector has a smaller width as compared to a case where two compression coil springs are provided side by side. Further, since the compression coil spring is in the widthwise center of the connector, a biasing force acting in the separating direction on the female connector is well-balanced and the mating connector is unlikely to be twisted when being forcibly separated.

The lock arm may have arm pieces at opposite lateral sides of the accommodation space and a front-stop couples the front ends of the arm pieces. The front-stop contacts the front end of the biasing member when the mating connector is not connected to prevent the biasing member from coming out of the accommodation space. The lock arm resiliently deforms the front-stop in the process of connecting the mating connector, and the mating connector disengages the front-stop from the front end of the biasing member. The mating connector then substantially contacts the front end of the biasing member. Accordingly, a connection detecting function displayed by the contact of the mating connector with the front end of the biasing member cannot be hindered.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
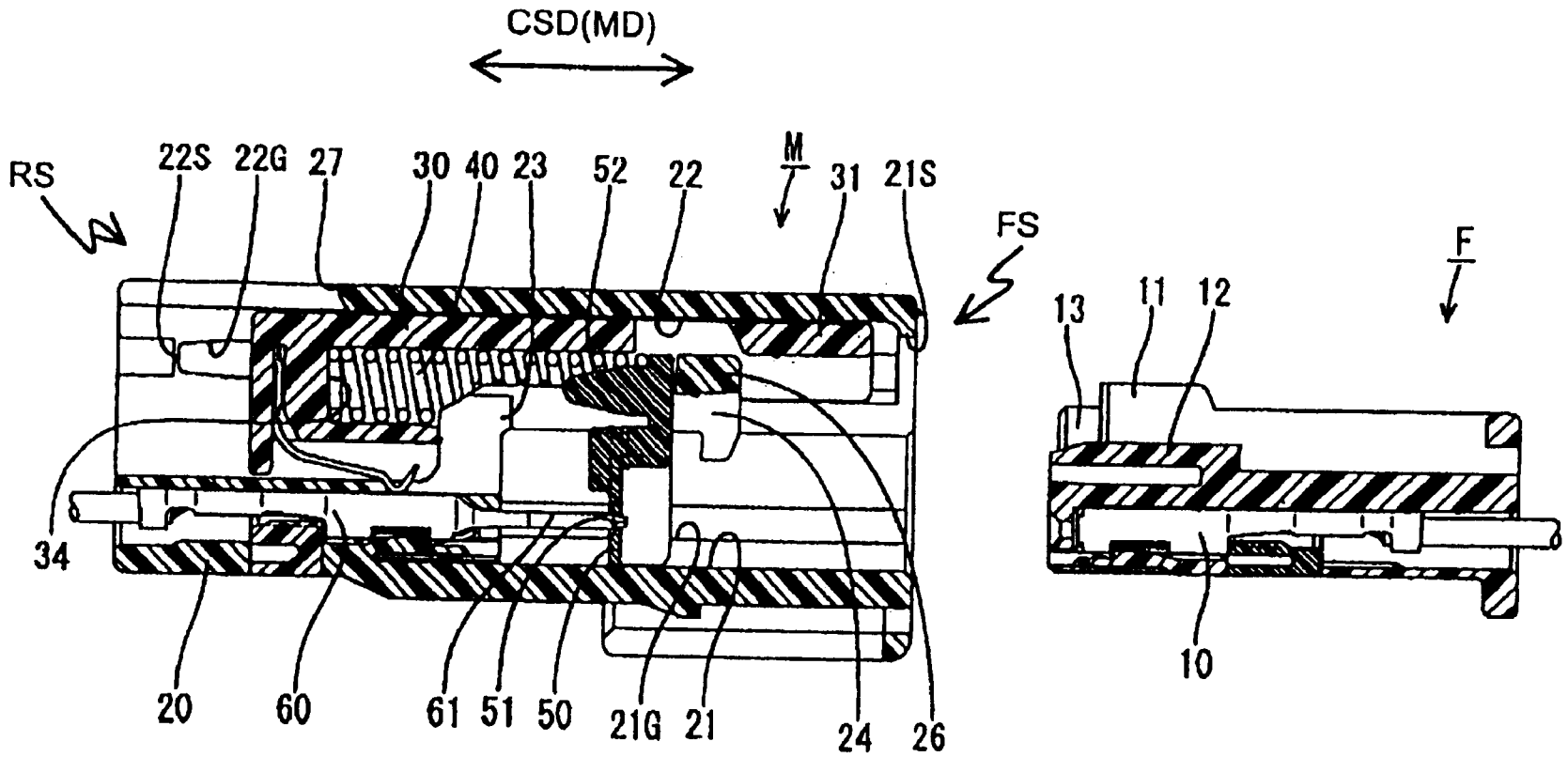
FIG. 1 is a section showing a state before a mating connector is connected in one embodiment of the invention.

A first embodiment of the invention is described with reference to FIGS. 1 to 9, and includes a female connector F to be connected with a male connector M. The female connector F accommodates female terminal fittings 10 inside, and a pushing portion 11 projects at substantially a widthwise center of the upper surface of the female connector F. Left and right locking projections 12 are formed at substantially opposite sides of the pushing portion 11 and define long ribs that extend longitudinally forward and backward. Long narrow left and right disengaging ribs 13 also project from the upper surface of the female connector F at positions more outward than the corresponding locking projections 12 along the widthwise direction. The disengaging ribs 13 also extend longitudinally in forward and backward directions.

The male connector M has a housing 20 formed with an engaging recess 21, and the female connector F is insertable into the engaging recess 21 from a front side FS. Male terminal fittings 60 are accommodated in the housing 20 and include tabs 61 that project forward into the engaging recess 21. An accommodation space 22 is formed in the housing 20 and extends from the front end of the engaging recess 21 to the rear end of the housing 20. Approximately the front half of the accommodation space 22 communicates with the engaging recess 21, and approximately the rear half of the accommodation space 22 is located above the male terminal fittings 60. A holding portion 23 is formed at the rear side RS of the engaging recess 21.

A forked lock arm 24 is cantilevered to extend forward from the back end of the engaging recess 21. The lock arm 24 normally is held at a locking position where it extends substantially horizontally along a moving direction MD (see FIGS. 4 and 5). However, the lock arm 24 is resiliently deformable up to an unlocking position (see FIGS. 2 and 3). Left and right disengaging projections 25 project laterally from the front end of the lock arm 24, and a front-stop 26 is formed substantially in the widthwise center of the front end of the lock arm 24. A notch 27 is formed at the rear end of the upper wall of the housing 20 and is used to cancel locking by the lock arm 24.

A slider 30 is accommodated in the accommodation space 22 and is movable along the moving direction MD between a forward disengaging position (see FIG. 6) and a rearward releasing position (see FIG. 5) and a returning position (see FIGS. 1–4). Movement of the slider 30 is guided by guide grooves 22G formed in the left and right lateral surfaces of the accommodation space 22. Forward movement of the slider 30 beyond the disengaging position is prevented by a front stopper 21S at the upper front end of the engaging recess 21 and backward movement of the slider 30 beyond the releasing position is prevented by rear stoppers 22S formed at the guide grooves 22G.

Figure 5A:
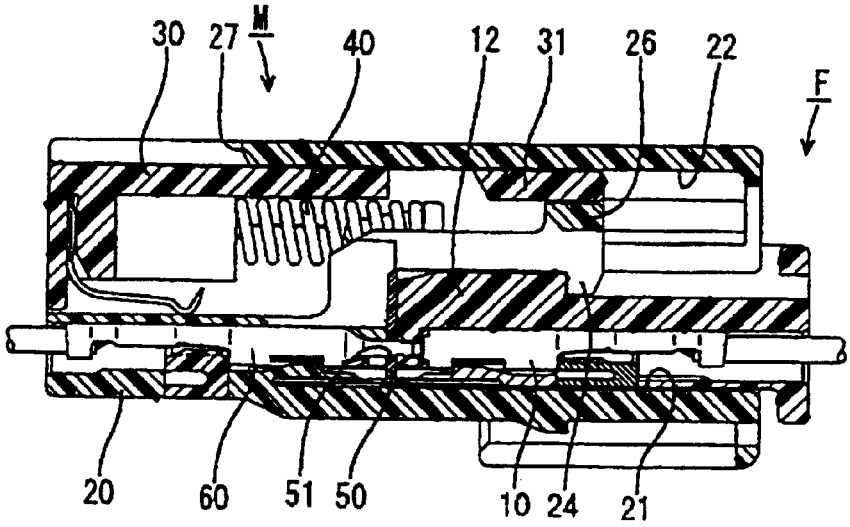
FIGS. 5(A) and 5(B) are sections showing a state of the lock arm and a released state of a returning spring when the mating connector is properly connected, respectively.
Figure 5B:
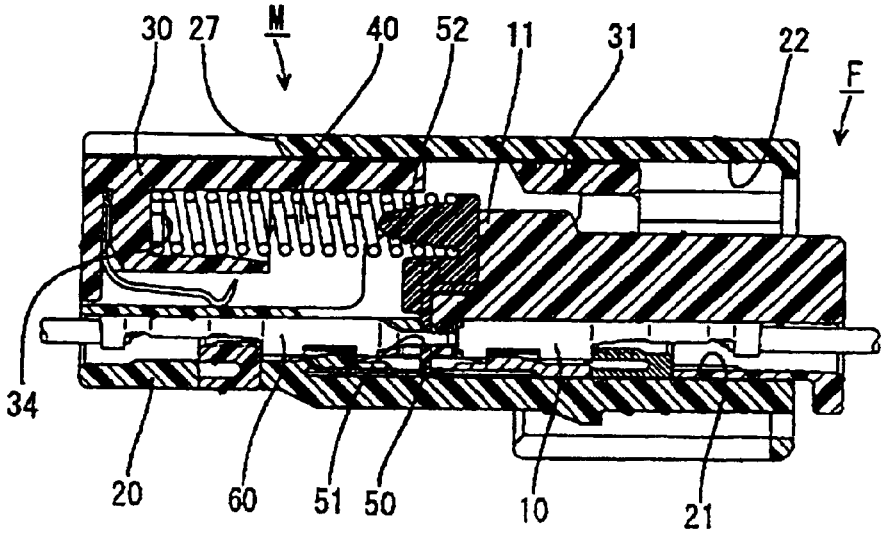

A movement preventing portion 31 is formed at the front end of the slider 30. The movement preventing portion 31 is above the lock arm 24 when the lock arm 24 is at the locking position and is substantially at the same height as the front end of the lock arm 24 when the lock arm 24 is deformed to the unlocking position. The movement preventing portion 31 engages the front end of the lock arm 24 from the front when the slider 30 is at the returning position and when the lock arm 24 is deformed to the unlocking position (FIG. 3), thereby preventing backward movement of the slider 30. The lock arm 24 can be deformed to the locking position and disengaged from the movement preventing portion 31 so that the slider 30 is permitted to move backward toward the releasing position (FIG. 5).

The slider 30 has left and right resilient holding pieces 32. The resilient holding pieces 32 are configured to engage the holding portion 23 of the housing 20 when the slider 30 is at the returning position to prevent backward movement of the slider 30. However, the resilient holding pieces 32 can be deformed up and out of engagement with the holding portion 23 so that the slider 30 can move toward the releasing position (FIG. 5).

The slider 30 has left and right unlocking pieces 33 that face the disengaging projections 25 of the lock arm 24 from behind when the slider 30 is at the returning position and when the lock arm 24 is at the locking position. The unlocking pieces 33 contact the disengaging projections 25 as the slider 30 is moved forward from the returning position to the disengaging position to deform the lock arm 24 to the unlocking position.

A returning spring 40 is accommodated inside the slider 30. The returning spring 40 is a compression coil spring with a longitudinal axis that extends forward and backward substantially along the moving direction MD. A spring contact surface 34 of the slider 30 contacts the rear end of the returning spring 40 and is movable together with the rear end of the returning spring 40.

A moving plate 50 is accommodated in the engaging recess 21, and is movable forward and backward substantially parallel with the connecting and separating directions CSD of the connectors F, M between an initial position (see FIG. 1) and a connection position (see FIGS. 4 to 6) behind the initial position. The moving plate 50 is guided by guide grooves 21G in the left and right surfaces of the engaging recess 21. Positioning holes 51 extend through the moving plate 50, and the tabs 61 of the male terminal fittings 60 pass through the positioning holes 51. The positioning holes 51 engage and position the front ends of the tabs 61 when the moving plate 50 is at the initial position. However, the moving plate 50 contacts the back end of the engaging recess 21 and the positioning holes 51 engage the base ends of the tabs 61 when the moving plate 50 is at the connection position.

A spring receiving portion 52 projects up from the upper end of a substantially widthwise center portion of the moving plate 50. The spring receiving portion 52 contacts and moves with the front end of the returning spring 40 in the slider 30. Thus, the returning spring 40 is held along the moving direction MD between the spring contact surface 34 of the slider 30 and the spring receiving portion 52 of the moving plate 50. The spring receiving portion 52 engages the front-stop 26 of the lock arm 24 from behind (FIG. 1) when the moving plate 50 is at the initial position, thereby preventing the moving plate 50 from moving more forward than the initial position. Further, the pushing portion 11 of the female connector F pushes the spring receiving portion 52 of the moving plate 50 from the front in the process of connecting the two connectors F, M.

The resilient holding pieces 32 engage the holding portion 23 (FIG. 3) to hold the slider 30 of the male connector M at the returning position and to prevent backward movement of the slider 30 before the female connector F is connected. Additionally, the spring receiving portion 52 engages the front-stop 26 of the lock arm 24 to hold the moving plate 50 at the initial position and to prevent forward movement. In this state, an initial spring force is accumulated in the returning spring 40 and the returning spring 40 is partly compressed.

Figure 2A:
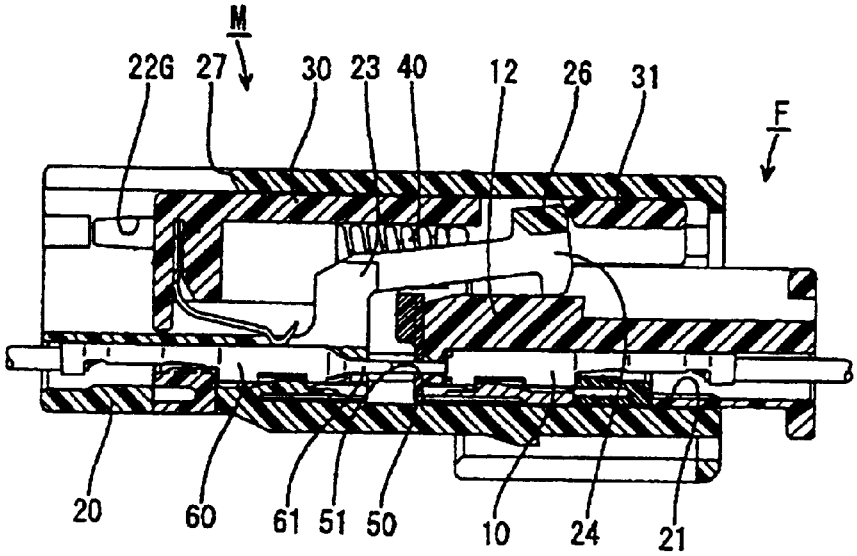
FIGS. 2(A) and 2(B) are sections showing a state of a lock arm and states of a moving plate and a slider during connection of the mating connector, respectively.
Figure 2B:
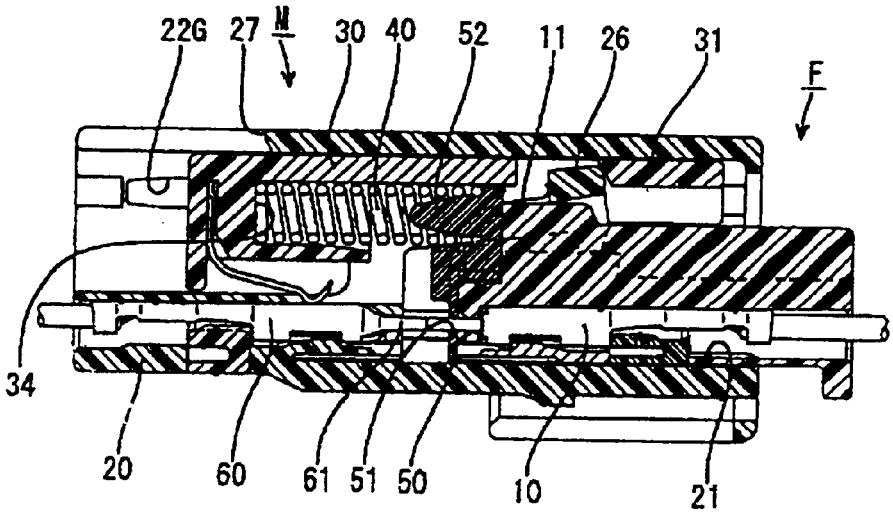
Figure 3:
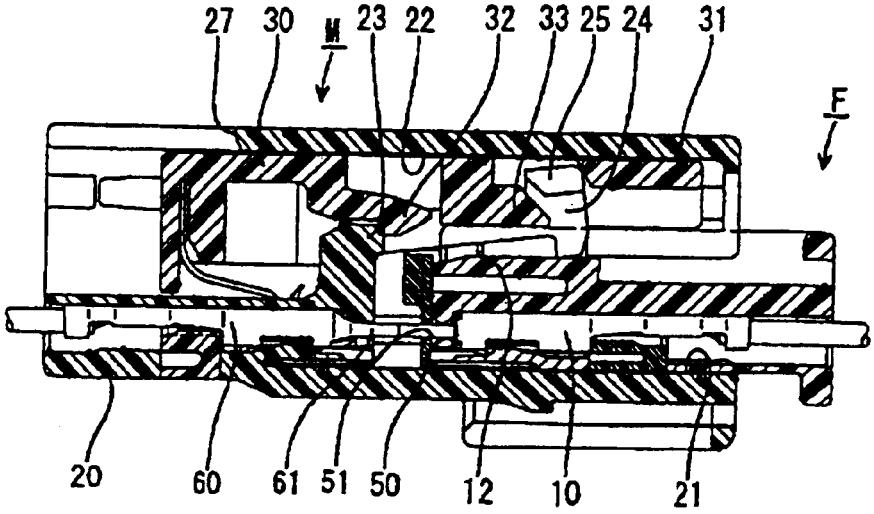
FIG. 3 is a section showing a state where the slider is held at a returning position during the connection of the mating connector.
Figure 4:
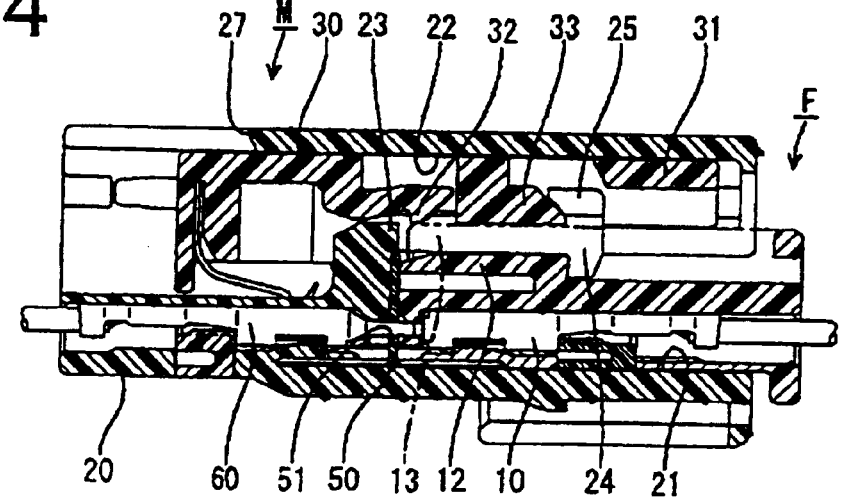
FIG. 4 is a section showing a state where the mating connector is properly connected to cancel a held state of the slider.

The female connector F is inserted into the engaging recess 21 in this state. Thus, the front end surface of the female connector F contacts the moving plate 50 and the pushing portion 11 contacts the spring receiving portion 52 to push the moving plate 50 back, as shown in FIG. 2. Additionally, the lock arm 24 moves onto the locking projections 12 and deforms resiliently to the unlocking position as the connection proceeds. During this time, the resiliently deformed lock arm 24 engages the movement preventing portion 31 and the resilient holding pieces 32 engage the holding portions 23, as shown in FIG. 3, to prevent the slider 30 from moving back. Thus, the spring receiving portion 52 is moved back and the returning spring 40 is compressed further and accumulates a biasing force.

The resilient force accumulated in the returning spring 40 causes the moving plate 50 and the spring receiving portion 52 to push the female connector F back out of the engaging recess 21 if the connection of the two connectors F, M is interrupted before reaching a properly connected state. This ejection of the female connector F from the recess 21 provides a clear indication of the insufficient connection of the two connectors F, M.

The disengaging ribs 13 of the female connector F deform the resilient holding pieces 32 out of engagement with the holding portion 23 at a stage immediately before the connectors F, M reach a properly connected state. Thus, the slider 30 is no longer held by the resilient holding pieces 32 and the holding portion 23. The lock arm 24 passes the locking projections 12 and returns resiliently to the locking position when the connectors F, M reach the properly connected state. Thus, the lock arm 24 engages the locking projections 12. In this way, the two connectors F, M are locked in their properly connected state and are prevented from separating from each other (see FIG. 4).

The slider 30 is freed from the engagement of the lock arm 24 and the movement preventing portion 31 when the lock arm 24 returns resiliently to the locking position. Thus, the biasing force accumulated in the returning spring 40 is released and moves the slider 30 back from the returning position to the releasing position (see FIG. 5).

The movement preventing portion 31 presses the front end of the lock arm 24 from above when the slider 30 is at the releasing position (FIG. 5). Thus, the movement preventing portion 31 prevents the lock arm 24 from deforming to the unlocking position, and keeps the lock arm 24 engaged with the locking projections 12. In this way, the reliability of the locking function by the lock arm 24 is improved. Further, the rear end of the slider 30 is exposed to outside through the notch when the slider 30 is at the releasing position.

The two connectors F, M may be connected sufficiently to push the moving plate 50 to the connection position. However, the two connectors F, M may be slightly short of complete connection. Thus, the lock arm 24 may be left on the locking projections 12 and may not be returned resiliently to the locking position. In such a case, the movement preventing portion 31 is kept engaged with the lock arm 24 at the unlocking position from the front and the slider 30 stays at the returning position without being able to move to the releasing position.

Figure 6:
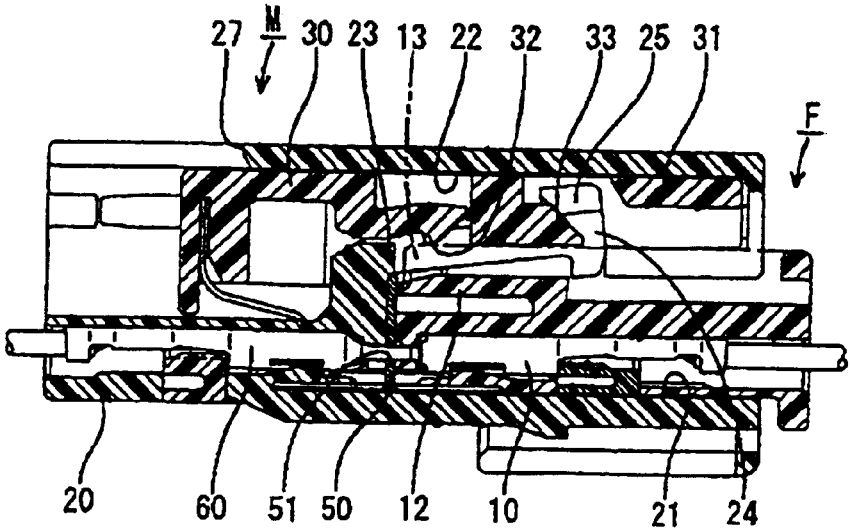
FIG. 6 is a section showing a state where the slider is operated to cancel locking by the lock arm with the mating connector properly connected.
Figure 7:
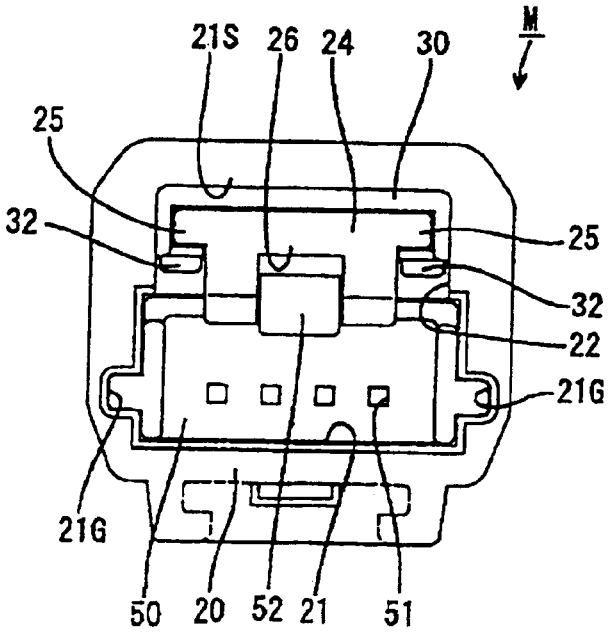
FIG. 7 is a front view of a connector.
Figure 8:
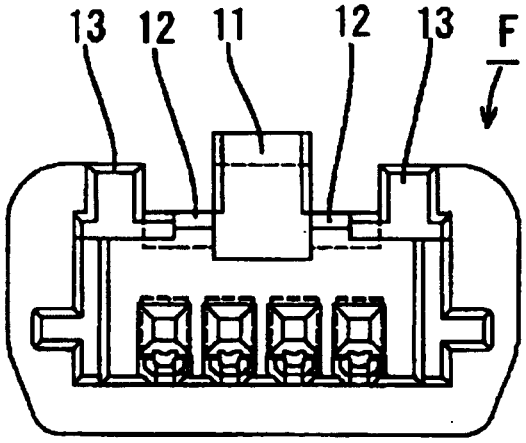
FIG. 8 is a front view of the mating connector.
Figure 9:
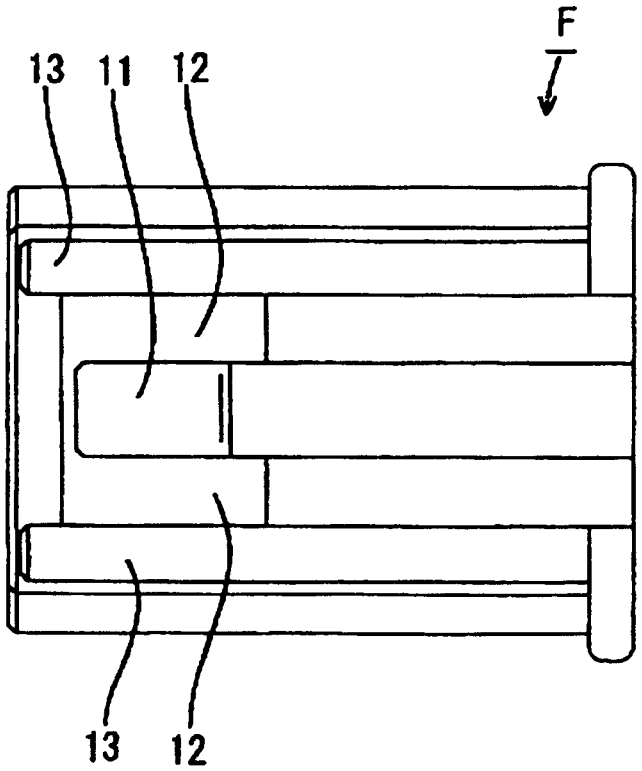
FIG. 9 is a plan view of the mating connector.
Figure 10:
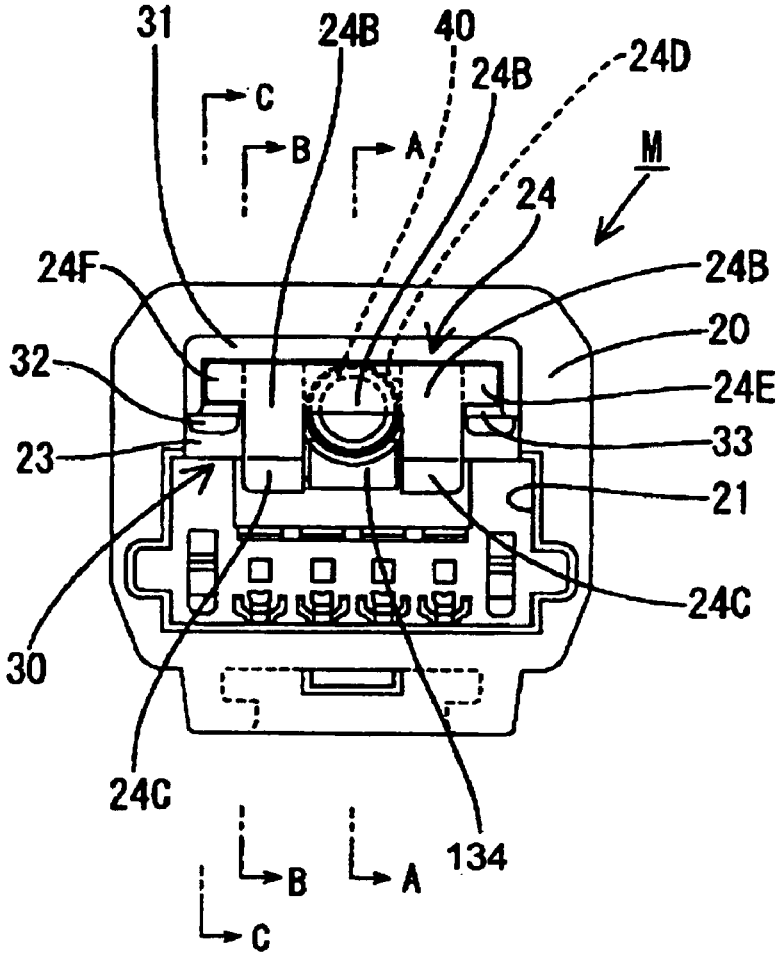
FIG. 10 is a front view of a male connector according to another preferred embodiment of the invention.

The two connectors F, M that have been locked in their properly connected state by the lock arm 24 can be separated by accessing the slider 30 through the notch 27 of the housing 20 and pushing the slider 30 forward to the disengaging position. Then, as shown in FIG. 6, the unlocking pieces 33 of the slider 30 forcibly deform the lock arm 24 to the unlocking position and the lock arm 24 disengages from the locking projections 12 when the slider 30 passes the returning position. Thus, the locked state of the two connectors F, M by the lock arm 24 is canceled. At this stage, the movement preventing portion 31 is more forward than the lock arm 24 and does not hinder the deformation of the lock arm 24. The moving plate 50 is held at the connection position by the female connector F substantially until locking by the lock arm 24 is canceled. Thus, the biasing force is accumulated in the returning spring 24 as the slider 30 is moved toward the disengaging position. Accordingly, at the same time the slider 30 cancels locking by the lock arm 24, the biasing force of the returning spring 40 returns the moving plate 50 to the initial position and pushes the female connector F out of the engaging recess 21.

The slider 30 is moved back by the biasing force of the returning spring 40 after the female connector F is separated. The resilient holding pieces 32 then engage the holding portion 23 to hold the slider 30 at the returning position. In this way, the slider 30, the moving plate 50 and the returning spring 40 all return to their states before the female connector F is connected.

As described above the slider 30 is movable to the releasing position to be separated from the moving plate 50 in such a state where the returning spring 40 is held between the moving plate 50 and the slider 30 and the two connectors F, M are connected properly. Thus, the biasing force of the returning spring 40 is released in a state where the two connectors F, M are connected properly and the moving plate 50 is at the connection position. Therefore, the returning spring 40 is free from permanent set in fatigue.

The slider 30 is freed from its state held at the returning position and is moved automatically from the returning position to the releasing position as the two connectors F, M are connected properly. Thus, it is not necessary to cancel the held state of the slider 30 separately from the connecting operation of the two connectors F, M. Therefore, operability is good.

The slider 30 is at the returning position when the two connectors F, M are connected insufficiently and the lock arm 24 is at the unlocking position. On the other hand, the slider 30 is moved from the returning position to the releasing position by the restoring force of the returning spring 40 when the connectors F, M are connected properly and the lock arm 24 is returned resiliently to the locking position. Thus, the locked state of the connectors F, M by the lock arm 24 can be detected based on whether the slider 30 has been moved to the releasing position.

Locking by the lock arm 24 is canceled with the biasing force accumulated in the returning spring 24 by moving the slider 30 from the releasing position toward the returning position. Thus, an operation of canceling locking by the lock arm 24 and an operation of pushing the female connector F by means of the returning spring 40 are performed automatically merely by unlocking the slider 30. Thus, operability is good.

A second embodiment of the invention is described with reference to FIGS. 10 to 25. The second embodiment also includes a female connector F to be connected with a male connector M. The female connector F accommodates female terminal fittings 10 inside, and a pushing portion 11 projects at a substantially widthwise center position of the upper surface of the female housing F. The front end of the pushing portion 11 defines a flat pushing surface 11S aligned at right angles to connecting directions CSD of the two connectors F, M. Left and right locking projections 12 are formed on the upper surface of the female connector F at the opposite sides of the pushing portion 11 and define long ribs that extend longitudinally in forward and backward directions. Left and right disengaging ribs 13 project at positions more outward than the corresponding locking projections 12 along the widthwise direction and are narrow and long in forward and backward directions.

The male connector M has a housing 20 and male terminal fittings 150 are accommodated in the housing 20. The housing 20 is formed with an engaging recess 21 dimensioned to receive the female connector F from a front side FS, and tabs 151 of the male terminal fittings 150 project forward in the engaging recess 21. An accommodation space 22 is formed inside the housing 20 and extends from the front end of the engaging recess 21 to the rear end of the housing 20. A substantially front half of the accommodation space 22 communicates with the engaging recess 21, and a substantially rear half thereof is located above the male terminal fittings 150. A holding portion 23 is formed at the back end of the engaging recess 21.

A transversely symmetrical forked lock arm 24 is cantilevered from the back end of the engaging recess 21 and extends forward along the connecting and separating directions CSD. The lock arm 24 includes long narrow left and right lateral arm pieces 24A that extend longitudinally in forward and backward directions. A front-stop 24B couples the front upper ends of the arm pieces 24A and a locking claw 24C projects down from the front end of each arm piece 24A. An accommodation space 24D surrounds the two arm pieces 24A and the front-stop 24B. The accommodation space 24D is substantially in the widthwise center of the lock arm 24 and opens in both upper and bottom surfaces of the lock arm 24. An area below the front-stop 24B and at the front end of the accommodation space 24D is open forward of the lock arm 24.

This lock arm 24 normally is held at a locking position where it extends substantially horizontally along the connecting and separating directions CSD (see FIGS. 11 to 13, 23 and 24). However, the lock arm 24 is resiliently deformable upward to an unlocking position (see FIGS. 22 and 25). Left and right disengaging projections 24E project out from the front ends of the arm pieces 24A. A notch 27 is formed at the rear end of the upper wall of the housing 20 to cancel locking by the lock arm 24 as explained herein.

A horizontal plate-shaped slider 30 is disposed in the accommodation space 22 for movement forward and back along a moving direction MD, which is substantially parallel with the connecting and separating directions CSD of the connectors F, M. The slider 30 is guided by guide grooves 22G formed in left and right lateral surfaces of the accommodation space 22. A disengaging position is defined at the front side FS of the movable path of the slider 30 (see FIG. 25), and a releasing position is defined at the rear side RS of the movable path of the slider 30 (see FIG. 24). A returning position is slightly behind the disengaging position (see FIG. 11). Forward movement of the slider 30 beyond the disengaging position is prevented by a front stopper 21S at the upper front end of the engaging recess 21 and backward movement of the slider 30 beyond the releasing position is prevented by rear stoppers 22S formed at the guide grooves 22G.

A horizontal plate-shaped movement preventing portion 31 is formed at the front end of the slider 30 and is above the lock arm 24 when the lock arm 30 is at the locking position. The movement preventing portion 31 is substantially at the same height as the front-stop 24B at the front end of the lock arm 24 when the lock arm 24 is deformed resiliently to the unlocking position. The movement preventing portion 31 engages the front-stop 24B of the lock arm 24 from the front when the slider 30 is at the returning position (FIG. 11) and when the lock arm 24 is deformed resiliently to the unlocking position, thereby preventing backward movement of the slider 30. The lock arm 24 disengages from the movement preventing portion 31 when the lock arm 24 is deformed toward the locking position so that the slider 30 can move back toward the releasing position.

Figure 11:
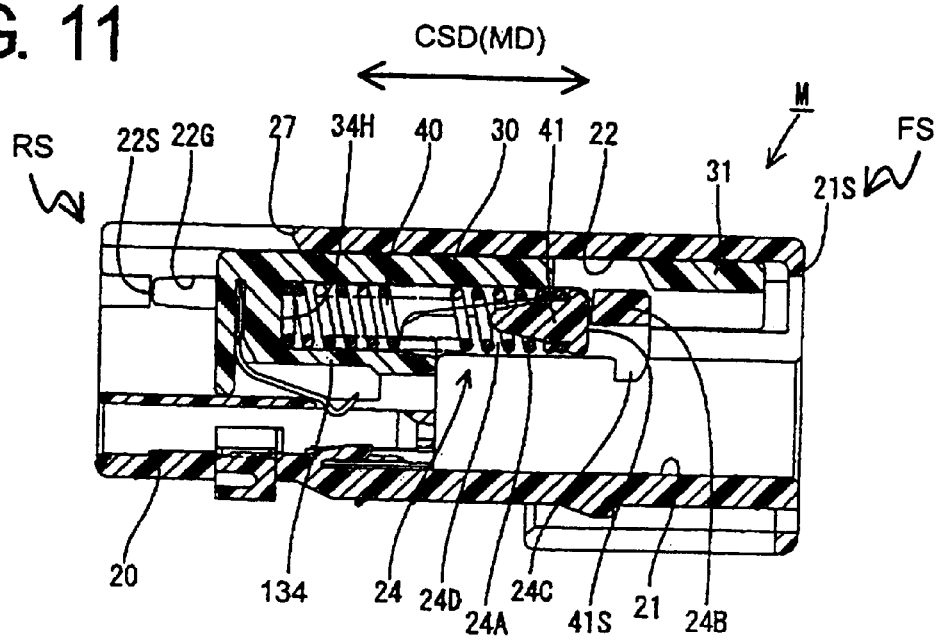
FIG. 11 is a section along 11—11 of FIG. 10.
Figure 12:
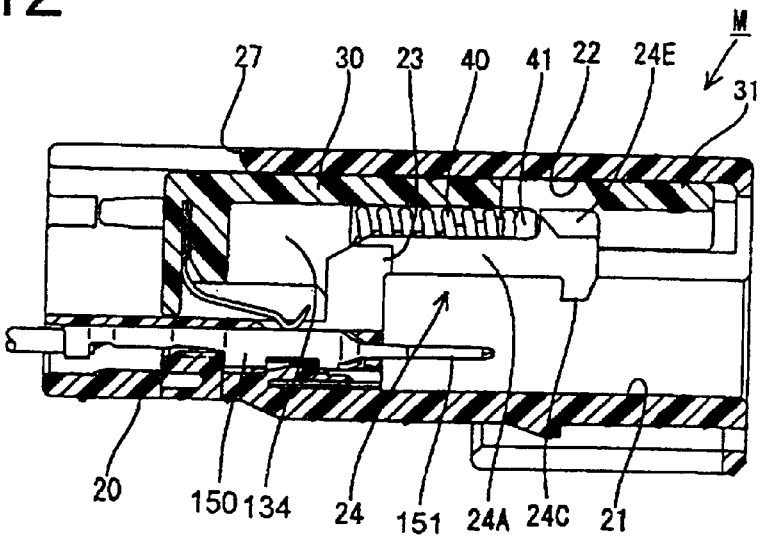
FIG. 12 is a section along 12—12 of FIG. 10.
Figure 13:
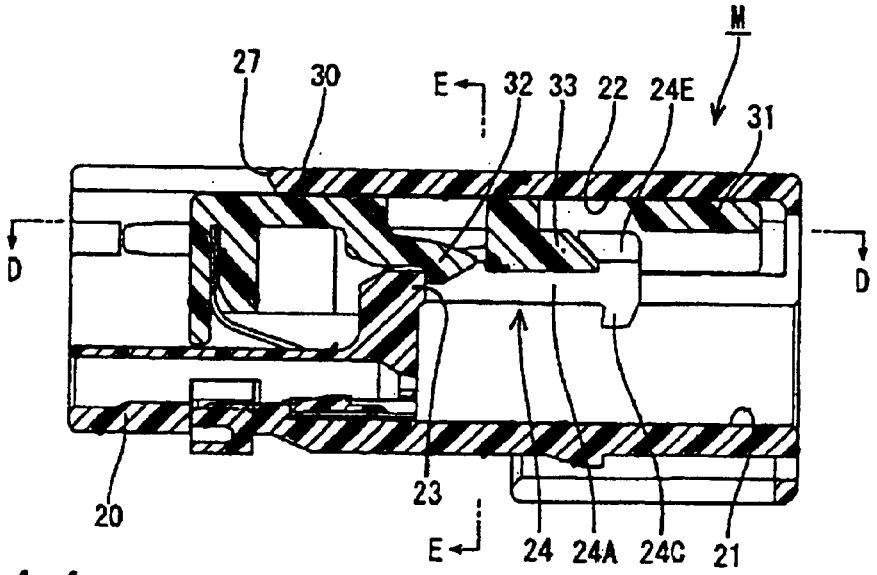
FIG. 13 is a section along 13—13 of FIG. 10.
Figure 14:
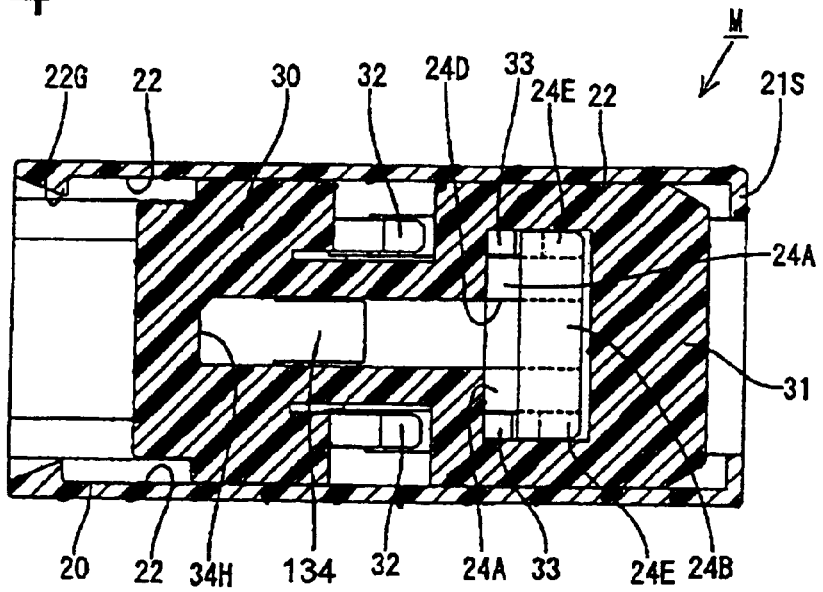
FIG. 14 is a section along 14—14 of FIG. 13.
Figure 15:
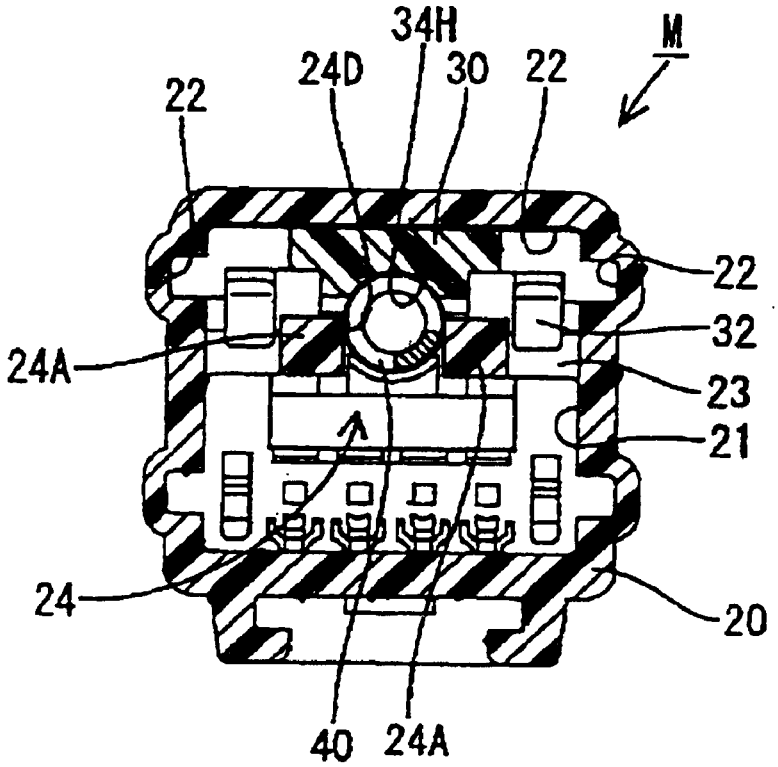
FIG. 15 is a section along 15—15 of FIG. 13.
Figure 16:
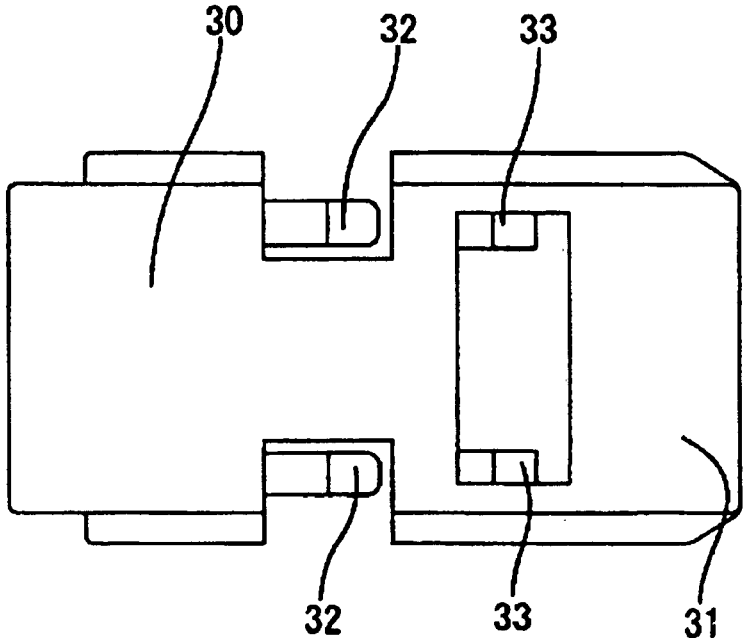
FIG. 16 is a plan view of a slider.
Figure 17:
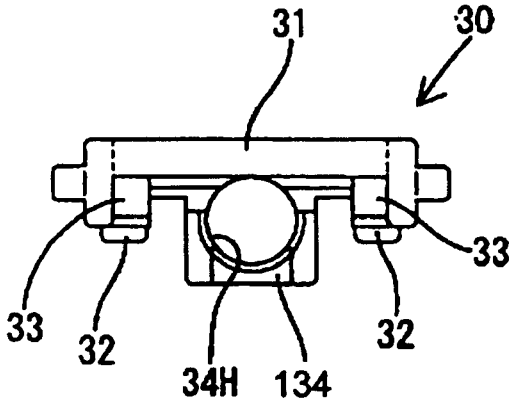
FIG. 17 is a front view of the slider.
Figure 18:
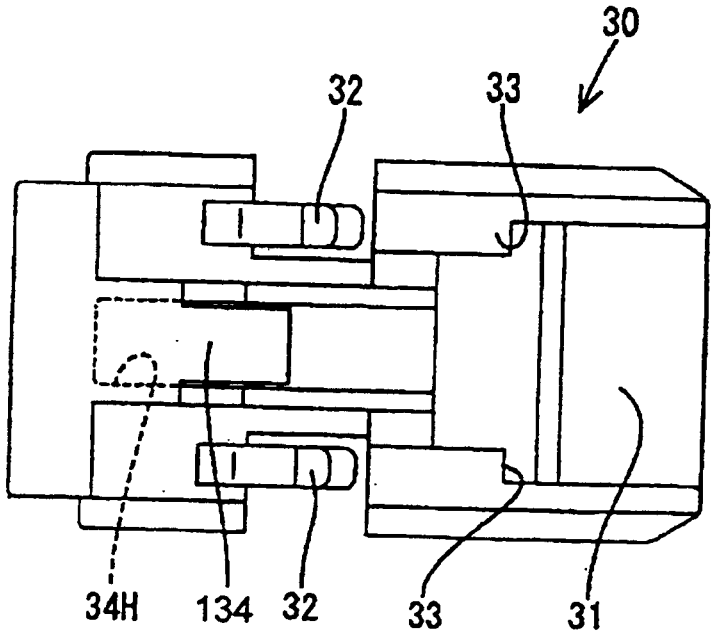
FIG. 18 is a bottom view of the slider.
Figure 19:
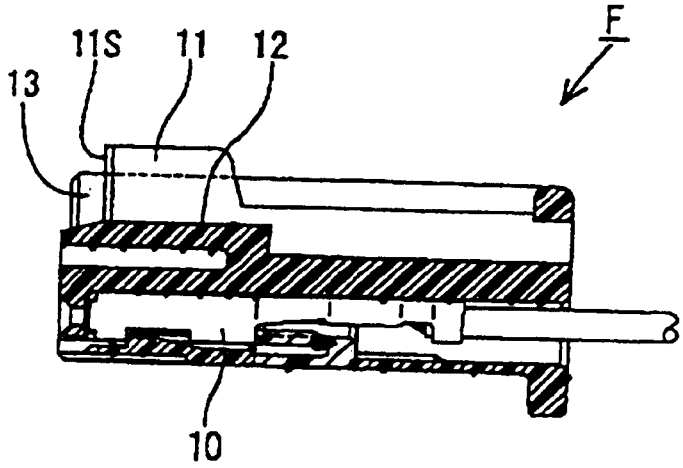
FIG. 19 is a section of a female connector.
Figure 20:
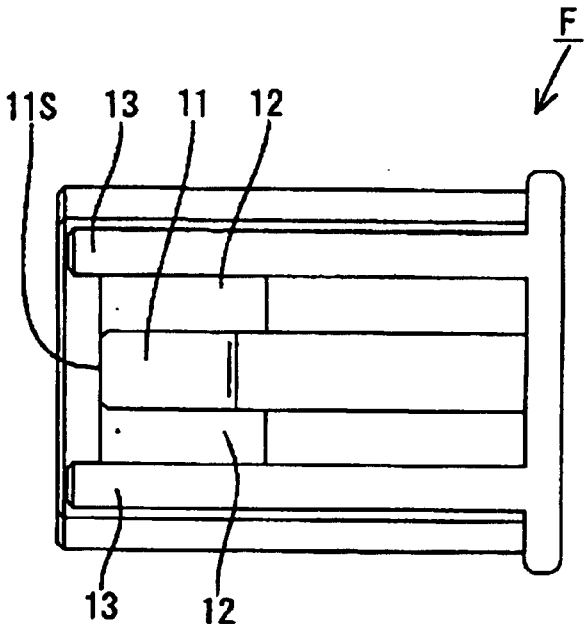
FIG. 20 is a plan view of the female connector.
Figure 21:
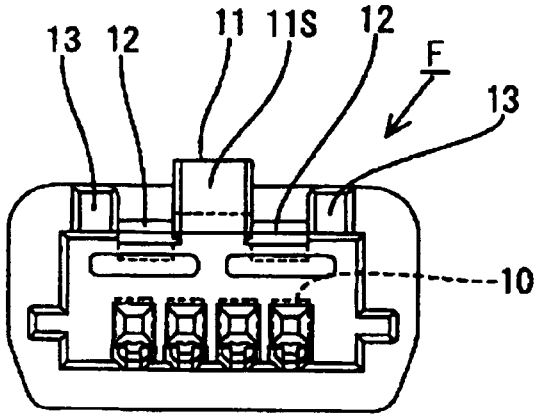
FIG. 21 is a front view of the female connector.

The slider 30 has left and right resilient holding pieces 32 that are resiliently deformable up for engagement with the holding portion 23 of the housing 20 when the slider 30 is at the returning position (FIG. 11). Backward movement of the slider 30 toward the rear side RS is prevented by engagement of the resilient holding pieces 32 and the holding portion 23. The slider 30 can move toward the releasing position if the resilient holding pieces 32 are deformed resiliently upward and disengaged from the holding portion 23 in this state.

Figure 23:
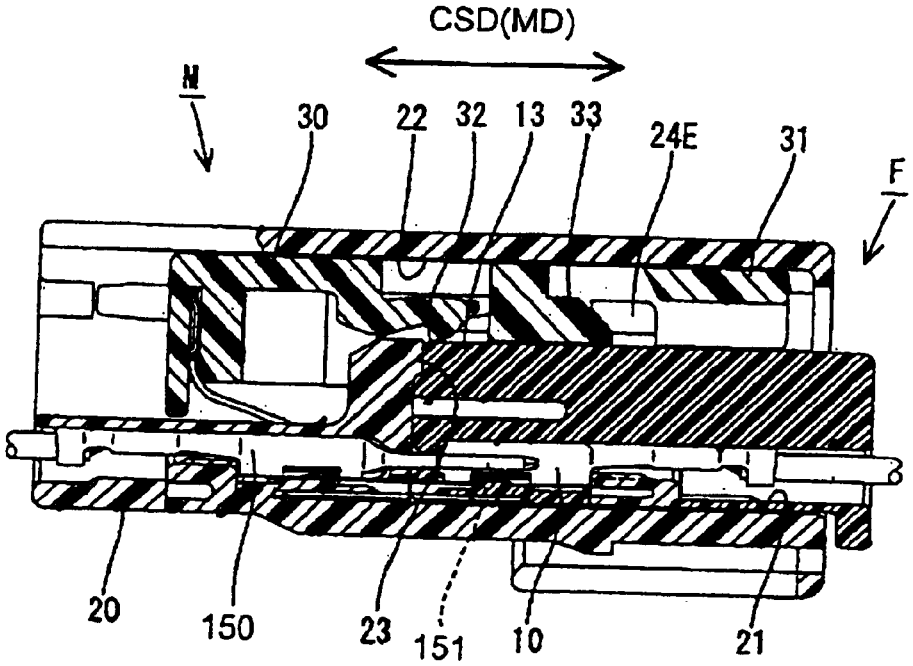
FIG. 23 is a section showing a state immediately before the proper connection of the male and female connectors.
Figure 24A:
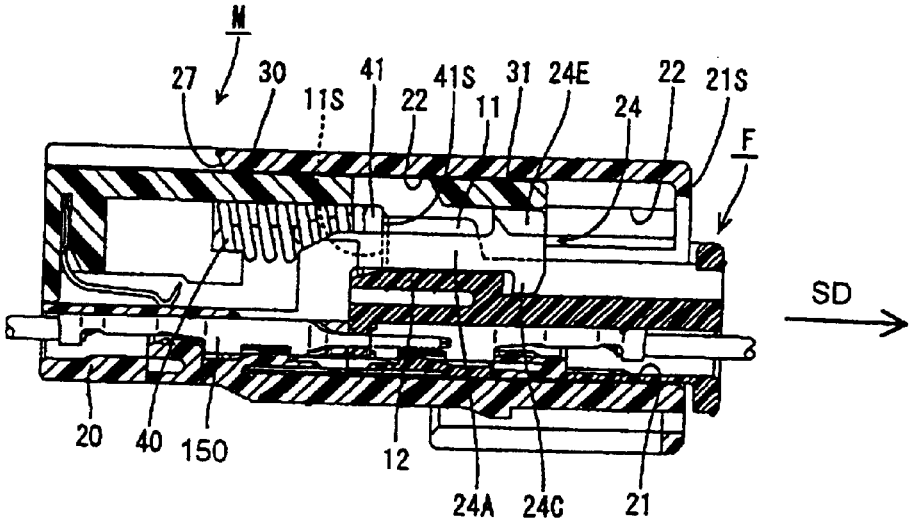
FIG. 24 is a section showing a state where the male and female connectors are properly connected.
Figure 24B:
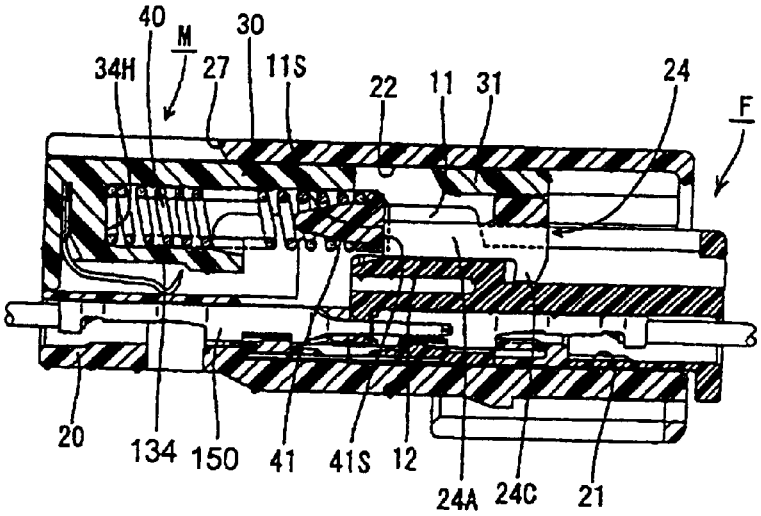

The slider 30 has left and right unlocking pieces 33 that face the disengaging projections 24E of the lock arm 24 from behind in proximity to the disengaging projections 24E when the slider 30 is at the returning position and the lock arm 24 is at the locking position. The unlocking pieces 33 engage the disengaging projections 24E as the slider 30 is moved forward from the returning position to the disengaging position, thereby forcibly deforming the lock arm 24 toward the unlocking position (FIG. 23).

A spring accommodating portion 134 projects down in the widthwise center of the slider 30 and has a forwardly open substantially round hole 34H. The spring accommodating portion 134 aligns with the accommodation space 24D of the lock arm 24 when the lock arm 24 is at the locking position. A compression coil spring 40 is accommodated in the spring accommodating portion 134 so that the longitudinal axis of the spring 40 extends forward and backward along the moving direction MD. The rear end of the compression coil spring 40 contacts the back end surface of the round hole 34H from the front and the front of the compression coil spring 40 projects forward from the spring accommodating portion 134. The compression coil spring 40 is accommodated entirely in the accommodation space 24D with respect to the widthwise direction (see FIGS. 10, 14 and 15). However, substantially the upper half of the compression coil spring 40 projects up from the accommodation space 24 (see FIGS. 12 and 15).

The spring receiving member 41 is mounted at the front end of the compression coil spring 40. The front end surface of the spring receiving member 41 defines a substantially flat round receiving surface 41S substantially normal to the connecting directions CSD of the connectors F, M. The receiving surface 41S is slightly larger than the pushing surface 11S of the female connector F and is opposed to the pushing surface 11S from the front with respect to vertical and transverse directions. An initial resilient force is accumulated in the compression coil spring 40 and biases the spring receiving member 41 against the front-stop 24B of the lock arm 24 when the female connector F is not connected and when the slider 30 is at the releasing position. This engagement prevents the compression coil spring 40 from coming out of the spring accommodating portion 134 and the accommodation space 24D (see FIG. 11). The front end of the compression coil spring 40 and the spring receiving member 41 are movable forward and backward in the accommodation space 24D.

Before the female connector F is connected, the slider 30 of the male connector M is held at the returning position (FIGS. 11 and 13) by the engagement of the resilient holding pieces 32 and the holding portion 23, and hence the slider 30 is prevented from backward movement. Additionally, the compression coil spring 40 is compressed resiliently between the back end surface of the spring accommodating portion 134 and the front-stop 24B (see FIG. 11).

Figure 22A:
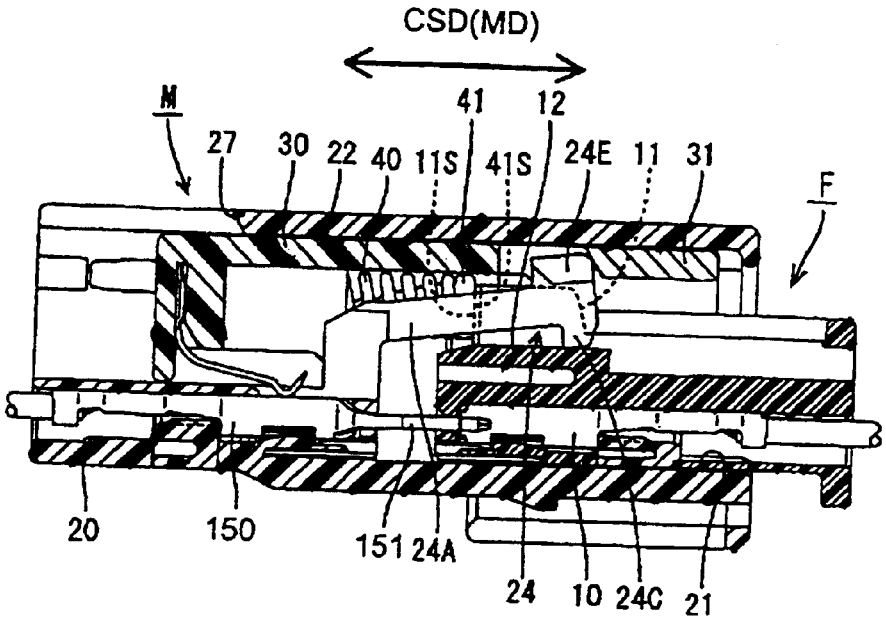
FIG. 22 is a section showing an intermediate stage of connection of the male and female connectors.
Figure 22B:
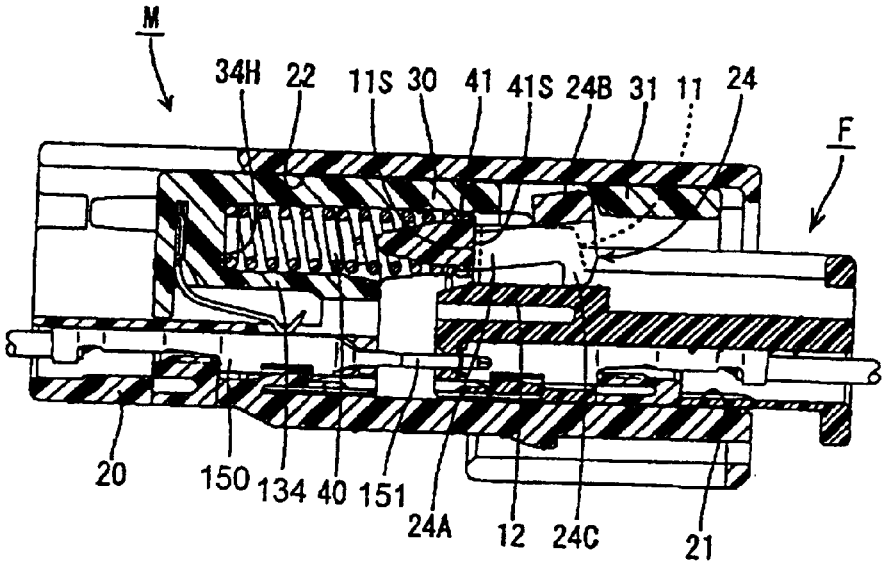
Figure 25:
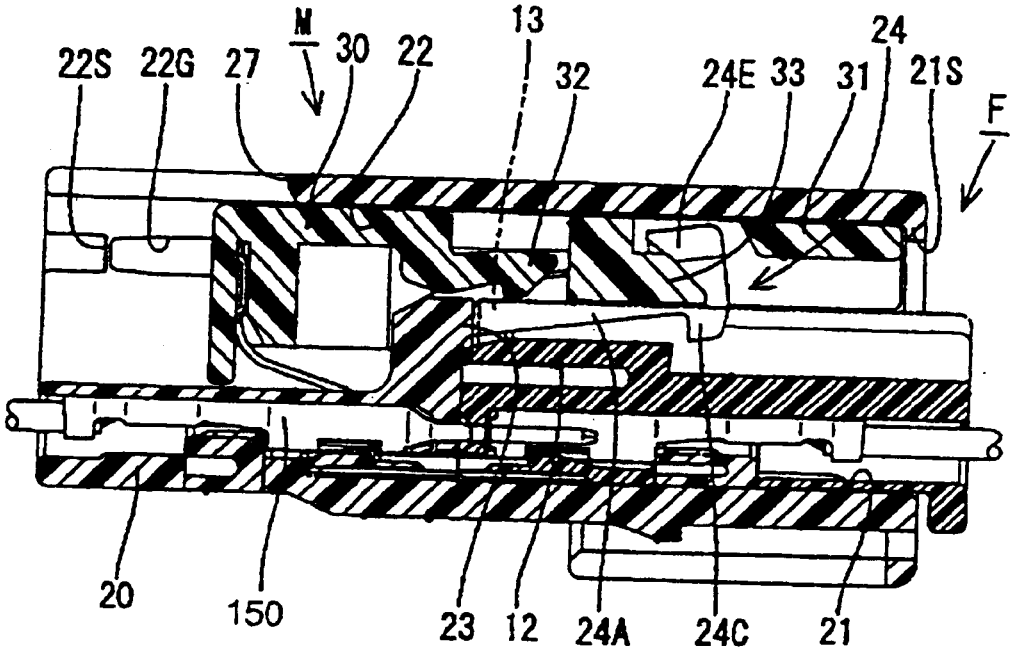
FIG. 25 is a section showing a state where a locked state of the female and male connectors is canceled.

The lock arm 24 is deformed resiliently up toward the unlocking position when the female connector F is fit into the engaging recess 21 (FIGS. 22, 25). Thus, the locking claws 24C at the front end of the lock arm 24 move onto the locking projections 12 (see FIG. 22) and the front-stop 24B is retracted up from the insertion path of the pushing portion 11 of the female connector F. Subsequently, the pushing portion 11 slips under the front-stop 24B (see FIG. 24), and the pushing surface 11S of the pushing portion 11 contacts a wide area of the receiving surface 41S of the spring receiving member 41 (see FIG. 24(*b*)), thereby pushing the spring receiving member 41 back toward the rear side RS. During this time, the slider 30 is prevented from moving back by the engagement of the movement preventing portion 31 with the resiliently deformed lock arm 24 and the engagement of the holding portions 23 with the resilient holding pieces 32 (see FIGS. 13 and 22). Thus, the compression coil spring 40 is compressed as the spring receiving member 41 is moved back, thereby increasing the biasing force accumulated in the compression coil spring 40.

If the connection of the connectors F, M is interrupted before reaching a properly connected state, the spring receiving member 41 pushes the female connector F back out of the engaging recess 21 by the resilient force accumulated in the compression coil spring 40. Thus, the insufficiently connected state of the two connectors F, M is detected.

The resilient holding pieces 32 are deformed resiliently by the disengaging ribs 13 of the female connector F immediately before the properly connected state of the two connectors F, M, and thus the resilient holding pieces 32 disengage from the holding portion 23. As a result, the slider 30 is released from engagement by the resilient holding pieces 32 and the holding portion 23 (see FIG. 23). The lock arm 24 passes the locking projections 12 and returns resiliently to the locking position when the connectors F, M reach the properly connected state. As a result, the lock arm 24 engages the locking projections 12. In this way, the connectors F, M are locked in their properly connected state and are prevented from separating in the separating direction SD (see FIG. 24). The front-stop 24B is displaced down after passing the pushing portion 11. As a result, the resilient returning movement of the lock arm 24 to the locking position is not hindered by the mutual interference of the front-stop 24B and the pushing portion 11.

The slider 30 is freed from engagement of the lock arm 24 and the movement preventing portion 31 when the lock arm 24 is returned resiliently to the locking position. Thus, the slider 30 is moved from the returning position (FIG. 11) to the releasing position (FIG. 24) behind the returning position by the biasing force accumulated in the compression coil spring 40 (see FIG. 24). The biasing force accumulated in the compression coil spring 40 is released as the slider 30 is moved to the releasing position. Further, the movement preventing portion 31 is located to press the front-stop 24B of the lock arm 24 from above when the slider 30 is at the releasing position (FIG. 24), thereby preventing the lock arm 24 from being deformed to the unlocking position (shown in FIG. 22, 25) and preventing the lock arm 24 from being disengaged from the locking projections 12. In this way, the reliability of the locking function by the lock arm 24 is improved. Further, the rear end of the slider 30 is exposed to outside through the notch 27 when the slider 30 is at the releasing position.

The two connectors F, M may be connected sufficiently to push the spring receiving member 41 to the connection position. However, the lock arm 24 may be left on the locking projections 12 and may not be returned resiliently to the locking position if the connection of the two connectors F, M is slightly insufficient. In such a case, the slider 30 stays at the returning position without being able to move to the releasing position since the movement preventing portion 31 is kept engaged with the lock arm 24 at the unlocking position from front.

The connectors F, M can be separated by engaging the slider 30 exposed at the notch 27 of the housing 20 and pushing the slider 30 forward to the disengaging position (FIG. 25) via the returning position (FIG. 11). Then, as shown in FIG. 25, the unlocking pieces 33 of the slider 30 contact the disengaging projections 24E and deform the lock arm 24 away from the locking projections 12 when the slider 30 passes the returning position. Thus, the locked state of the connectors F, M by the lock arm 24 is canceled. At this stage, the movement preventing portion 31 is moved to a position more forward than the lock arm 24 and does not hinder the resilient deformation of the lock arm 24. The spring receiving member 41 is held at the retracted position by the female connector F until locking by the lock arm 24 is canceled. Thus, the biasing force is accumulated in the compression coil spring 40 as the slider 30 is moved forward toward the disengaging position (FIG. 25). Accordingly, at the same time the slider 30 cancels locking by the lock arm 24, the spring receiving member 41 is returned to the initial position while the female connector F is pushed out of the engaging recess 21 by the biasing force of the compression coil spring 40.

The slider 30 is moved back by the biasing force of the compression coil spring 40 after the female connector F is separated. The resilient holding pieces 32 engage the holding portion 23 when the slider 30 reaches the returning position (FIG. 11) to hold the slider 30 at the returning position. In this way, the slider 30, the compression coil spring 40 and the spring receiving member 41 all are returned to their states before the female connector F is connected.

As described above, at least part of the compression coil spring 40 is accommodated in the lock arm 24. As a result, the connector can be made smaller with respect to vertical and widthwise directions.

The lock arm 24 is at substantially the widthwise center of the housing 20, and the accommodation space 24D is formed by cutting away the widthwise center of the lock arm 24. Thus, it is sufficient to provide only one compression coil spring 40. Thus, the male connector M is narrower as compared to a case where two compression coil springs are provided side by side. Further, the compression coil spring 40 is substantially in the widthwise center on the male connector M. Thus, a biasing force acting in the separating direction of the female connector F is transversely well-balanced and the female connector F is unlikely to be twisted or skewed when being separated.

The lock arm 24 has the front-stop 24B. Thus, the compression coil spring 40 is prevented from coming out of the accommodation space 24D when the female connector F is not connected. Furthermore, the front-stop 24B is disengaged from the front end of the compression coil spring 40 as the female connector F is connected. Therefore, a connection detecting function displayed by the contact of the female connector F with the front end of the compression coil spring 40 cannot be hindered.

The front-stop 24B is disengaged from the front end of the compression coil spring 40 by the displacement of the lock arm 24 when the connection of the female connector F is started. Additionally, substantially the upper half of the front surface area of the compression coil spring 40 had been concealed by the front-stop 24B, but becomes exposed to the female connector F. Thus the female connector F can contact substantially the entire front surface (receiving surface 41S) of the compression coil spring 40. In this way, a sufficiently large contact area of the front surface of the compression coil spring 40 with the female connector F can be secured. Additionally, the contact area with the female connector F is at a position proximate to the longitudinal center of the compression coil spring 40 to prevent the compression coil spring 40 from being buckled. As a result, the compression coil spring 40 undergoes a smooth deformation.

The lock arm 24 functions as a displacing means for displacing in a direction retracted from a connection path of the female connector F while being disengaged from the compression coil spring 40 in the process of connecting the female connector F. Additionally, the lock arm has the front-stop 24B for stopping the compression coil spring 40 at its front-limit position. Thus, the construction of the connector can be simplified as compared to a case where a special displacing means for stopping the compression coil spring 40 at its front-limit position is provided separately from the lock arm 24.

The invention is not limited to the above described and illustrated embodiment. For example, the following embodiments also are embraced by the technical scope of the present invention as defined by the claims. Beside the following embodiments, various changes can be made without departing from the scope and spirit of the present invention as defined by the claims.

The returning spring is a compression coil spring in the foregoing embodiments. However, it may be a tension coil spring provided before the moving plate.

The slider is freed from its state held at the returning position when the mating connector is connected properly in the foregoing embodiments. However, the held state of the slider at the returning position may be canceled manually according to the present invention.

The slider is held at the returning position and freed from its state held at the returning position while being linked with the movements of the lock arm in the foregoing embodiments. However, the slider may be locked and unlocked without being linked with the movement of the lock arm according to the present invention.

Although the accommodation space is at the widthwise center of the lock arm in the second embodiment, two accommodation spaces may be formed at the left and right lateral sides of the lock arm according to the present invention.

What is claimed is:

1. A connector, comprising:

a housing having a front end and an engaging recess extending into the front end for receiving a mating connector;

terminal fittings accommodated in the housing and extending into the recess;

a biasing member in the housing and having front and rear ends, the front end of the biasing member facing toward the front end of the housing and being disposed for engagement by the mating connector;

a slider movable with the rear end of the biasing member between a front position and a rear position; and a holder configured for holding the slider at the front position and for canceling a held state of the slider and releasing the biasing member as the mating connector is connected properly, whereby the biasing member is substantially undeformed when the connector is connected properly with the mating connector.

2. The connector of claim 1, wherein the terminal fittings are male terminal fittings, tabs at the front ends of the terminal fittings projecting forward into the engaging recess.

3. The connector of claim 1, wherein the housing comprises a lock arm resiliently deformable from a locking position to an unlocking position in a connecting process with the mating connector and resiliently restorable to the locking position for engaging the mating connector for preventing the mating connector from being separated from the connector as the mating connector is properly connected.

4. The connector of claim 3, wherein the slider comprises a movement preventing portion for preventing movement of the slider from the returning position toward the releasing position by engaging the lock arm when the lock arm is in the unlocking position and for permitting movement of the slider to the releasing position by being disengaged from the lock arm when the lock arm is returned resiliently to the locking position.

5. The connector of claim 4, wherein the slider further comprises an unlocking piece for engaging the lock arm at the locking position to deform the lock arm to the unlocking position as the slider is moved from the releasing position toward the returning position.

6. The connector of claim 3, wherein the lock arm (24) comprises an accommodation space (24D) for accommodating at least part of the biasing member (40).

7. The connector of claim 6, wherein the lock arm is substantially at a widthwise center position and the accommodation space is formed in a substantially widthwise center portion of the lock arm.

8. A connector comprising;

a housing having a front end and an engaging recess extending into the front end for receiving a mating connector;

male terminal fittings accommodated in the housing and having tabs extending into the recess;

a biasing member in the housing and having front and rear ends, the front end of the biasing member facing toward the front end of the housing and being disposed for engagement by the mating connector;

a slider movable with the rear end of the biasing member between a front position and a rear position;

a holder configured for hold ma the slider; and a moving plate with positioning holes through which the tabs are passed, the moving plate being movable between an initial position where the positioning holes engage front ends of the tabs in the engaging recess for positioning the tabs and a connection position, located behind the initial position, where the positioning holes are displaced with respect to the tabs for engaging base ends of the tabs.

9. The connector of claim 8, wherein the biasing member biases the moving plate toward the initial position.

10. The connector of claim 9, wherein the holder is constructed to cancel the held state of the slider as the mating connector is properly connected.

11. A connector assembly comprising a first connector and a second connector, the first connector comprising:

a housing having a front end and an engaging recess extending into the front end for receiving the second connector;

terminal fittings accommodated in the housing and extending into the recess;

a biasing member in the housing and having front and rear ends, the front end of the biasing member facing toward the front end of the housing and being disposed for engagement by the mating connector;

a slider movable with the rear end of the biasing member between a front position and a rear position; and a holder configured for holding the slider at the front position and for canceling a held state of the slider and releasing the biasing member as the first and second connectors are connected properly, whereby the biasing member is substantially undeformed when the first and second connectors are connected properly.

12. The connector of claim 11, wherein the terminal fittings are male terminal fittings, tabs at the front ends of the terminal fittings projecting forward into the engaging recess.

13. The connector of claim 12, further comprising a moving plate with positioning holes through which the tabs are passed, the moving plate being movable between an initial position where the positioning holes engage front ends of the tabs in the engaging recess for positioning the tabs and a connection position, located behind the initial position, where the positioning holes are displaced with respect to the tabs (61) for engaging base ends of the tabs.

14. The connector of claim 13, wherein the biasing member biases the moving plate toward the initial position.

15. The connector of claim 11, wherein the housing comprises a lock arm resiliently deformable from a locking position to an unlocking position in a connecting process with the mating connector and resiliently restorable to the locking position for engaging the mating connector for preventing the mating connector from being separated from the connector as the mating connector is properly connected.

16. The connector of claim 15, wherein the slider comprises a movement preventing portion for preventing movement of the slider from the returning position toward the releasing position by engaging the lock arm when the lock arm is in the unlocking position and for permitting movement of the slider to the releasing position by being disengaged from the lock arm when the lock arm is returned resiliently to the locking position.

* * * * *